US010672303B1

(12) United States Patent
Armata

(10) Patent No.: US 10,672,303 B1
(45) Date of Patent: Jun. 2, 2020

(54) RIGID BANNER SUPPORT ASSEMBLY AND SYSTEM

(71) Applicant: BrandDriven Inc., Barrie (CA)

(72) Inventor: Mitchell Armata, Barrie (CA)

(73) Assignee: BrandDriven Inc., Barrie (CA)

( * ) Notice: Subject to any disclaimer, the term of this patent is extended or adjusted under 35 U.S.C. 154(b) by 0 days.

(21) Appl. No.: 16/369,424

(22) Filed: Mar. 29, 2019

(51) Int. Cl.
*G09F 7/18* (2006.01)
*G09F 17/00* (2006.01)

(52) U.S. Cl.
CPC ..... *G09F 7/18* (2013.01); *G09F 17/00* (2013.01); *G09F 2007/1804* (2013.01); *G09F 2007/1808* (2013.01); *G09F 2007/1817* (2013.01); *G09F 2007/1843* (2013.01); *G09F 2007/1847* (2013.01); *G09F 2017/005* (2013.01)

(58) Field of Classification Search
CPC ..... G09F 7/18; G09F 2007/1804; G09F 2007/1808; G09F 2007/1843; G09F 2007/1847; G09F 17/00; G09F 2017/005
See application file for complete search history.

(56) References Cited

U.S. PATENT DOCUMENTS 3,850,401 A * 11/1974 Snediker ..... A47B 97/02 248/292.13
4,095,360 A * 6/1978 Dinan ..... G09F 7/22 40/603
4,880,195 A * 11/1989 Lepley ..... G09F 17/00 248/219.4
5,388,794 A 2/1995 Wolff
5,463,973 A * 11/1995 Tait ..... G09F 17/00 116/173
6,192,611 B1 * 2/2001 Molla ..... G09F 15/0025 160/378
6,334,596 B1 * 1/2002 Temple ..... A45F 3/44 248/156
6,378,820 B1 * 4/2002 Mooney ..... G09F 17/00 116/173
6,565,052 B1 * 5/2003 Doublet ..... G09F 7/18 248/218.4
8,579,009 B2 * 11/2013 Messick, Jr. ..... E04F 13/0807 160/368.1
2008/0216974 A1 * 9/2008 Pitcher ..... G09F 7/18 160/330
2009/0146029 A1 * 6/2009 Beatty ..... G09F 7/18 248/206.5
2015/0059220 A1 * 3/2015 Lim ..... G09F 7/18 40/607.14

* cited by examiner

*Primary Examiner* — Gary C Hoge
(74) *Attorney, Agent, or Firm* — Eric J. Sosenko; Jonathan P. O'Brien; Honigman LLP

(57) ABSTRACT

A rigid banner support assembly is provided. The rigid banner support assembly comprises: an external arm having an open cavity and connectable to a support member; an internal arm located within the open cavity and connectable to a rigid banner; and at least one biasing member connecting the internal arm to the external arm and configured to permit vertical movement of the internal arm with respect to the external arm in response to a force.

26 Claims, 11 Drawing Sheets

RIGID BANNER SUPPORT ASSEMBLY AND SYSTEM

FIELD

This application relates to generally to banner support assemblies and in particular to rigid banner support assemblies and systems.

BACKGROUND

Banners are used to advertise products, promotions and events. One type of banner is a flexible banner such as for example a flag. Although flexible banners are useful, when used in outdoor environments they are prone to ripping and may fade over time due to elements such as for example wind, rain, snow, ice etc.

Another type of banner is a rigid banner which is made of a strong, rigid material such as for example aluminum. Rigid banners may be coated with material to prevent fading. Compared to flexible banners, rigid banners are less prone to damage caused by wind forces. Further, rigid banners may be cut in unique shapes to create aesthetically pleasing and creative displays.

Banner support assemblies are used to connect banners to support members such as poles, light posts, etc. in such a manner that the banners may be easily seen but are out of reach of the public. When used in outdoor environments, banner support assemblies may break due to elements such as wind, rain, snow, ice, etc. Some banner support assemblies have been designed to withstand these elements.

One such type of banner support assembly is provided by U.S. Pat. No. 5,388,794 to Wolff which discloses an apparatus for suspending a flexible banner with respect to an upstanding post and including a pair of base plates that are fixed in spaced relation on the post, the base plates each having a pair of grooves extending longitudinally of the post adjacent the side edges of the base plate and a pair of swing plates having a pair of longitudinally extending lips that rest normally in the pairs of grooves in the base plates and each having means for fixing a banner supporting rod in the swing plate whereby the swing plates and the rods may be pivoted with respect to the base plate, and a spring between each of the swing plates and its respective base plate for yieldably restraining swinging movement of the swing plate and its rod.

The apparatus disclosed by Wolff allows movement of a banner supporting rod under wind load. In Wolff, each banner supporting rod is made of fiberglass and extends through a respective hem in upper and lower edges of a flexible banner. The resilience of the fiberglass rods allows the rods to yield and bend and allows bellying out of the flexible banner under light winds or breezes, with the outer edge of the banner being arc-shaped. For greater wind velocities the resilience of the fiberglass rods is not sufficient for preventing destruction of the flexible banner, and as such swing castings swing or tilt against the action of springs. The swinging movement of the swing castings allow sufficient bellying of the flexible banner with its outer edge being in arcuate shape. For still greater wind velocities, a ball and socket-like joint allows rotation, tilting and pivoting of the swing castings to accommodate swinging of distal ends of the fiberglass rods, particularly toward and away from each other when differing wind velocities and directions.

Although the apparatus disclosed by Wolff is able to support flexible banners, it is not able to support rigid banners as Wolff relies on the flexible nature of fiberglass rods that that simply cannot support the weight of a rigid banner especially under wind load.

Although banner support assemblies have been considered, these banner support assemblies cannot support rigid banners and as such improvements are desired. It is therefore an object at least to provide a novel rigid banner support assembly.

SUMMARY

It should be appreciated that this Summary is provided to introduce a selection of concepts in a simplified form that are further described below in the Detailed Description. This Summary is not intended to be used to limit the scope of the claimed subject matter.

Accordingly, in one aspect there is provided a rigid banner support assembly, comprising an external arm having an open cavity and connectable to a support member, an internal arm located within the open cavity and connectable to a rigid banner, and at least one biasing member connecting the internal arm to the external arm and configured to permit vertical movement of the internal arm with respect to the external arm in response to a force.

In embodiments, the at least one biasing member comprises a bolt extending through openings in the external arm and the internal arm; a spring circumscribing the bolt at a position outside of the open cavity of the external arm; and at least one nut threadably connected to the bolt and at least partially compressing the spring.

In embodiments, when connected to the rigid banner, the internal arm moves vertically with respect to the external arm in response to a wind force above a threshold level being applied to the rigid banner.

In embodiments, the threshold level is at least partially dependent on a biasing force of the at least one biasing member.

In embodiments, the biasing force is a spring force.

In embodiments, the biasing force is generally normal to the wind force.

In embodiments, the rigid banner bows in response to the wind force thereby causing the internal arm to move vertically with respect to the external arm.

In embodiments, the external arm comprises a generally flat surface, two parallel-spaced walls extending at first ends from opposite edges of the generally flat surface, the open cavity defined between the two walls and the generally flat surface, and projections extending inwards from second ends of the two parallel-spaced walls, the projections defining a gap.

In embodiments, a range of vertical movement of the internal arm with respect to the external arm is at least partially defined by a biasing force of the biasing member.

In embodiments, the internal arm comprises a hollow and generally rectangular elongated body; and a pair of arms extending from opposing edges along a length of the elongated body which, together with a surface of the elongated body, define a U-shaped channel configured to receive a first end of the rigid banner.

In embodiments, the rigid banner support assembly comprises an attachment member comprising a body defining a slot, the slot configured to receive the first end of the rigid banner and the body dimensioned to fit within the U-shaped channel of the internal arm.

In embodiments, the attachment member comprises a number of teeth extending from the body, the teeth contacting walls of the U-shaped channel.

In embodiments, the rigid banner support assembly comprises a pole bracket defining a slot dimensioned to receive and connect to one end of the external arm and comprising an attachment portion configured to connect to the support member such that the external arm is generally normal thereto.

In embodiments, at least one strap is configured to connect the attachment portion to the support member.

In embodiments, the external arm and the internal arm are made of an aluminum material.

According to another aspect there is provided a rigid banner support system, comprising a first rigid banner support assembly comprising a first external arm having an open cavity and connectable to a support member; a first internal arm located within the open cavity and connectable to a first end of a rigid banner; and at least one first biasing member connecting the internal arm to the external arm and configured to permit vertical movement of the first internal arm with respect to the first external arm in response to a force; and a second rigid banner support assembly connectable to a second end of the rigid banner.

In embodiments, the second rigid banner support assembly comprises a second external arm having an open cavity and connectable to the support member, and a second internal arm located within the open cavity and connectable to the second end of the rigid banner.

In embodiments, the second internal arm is fixed in position with respect to the second external arm.

In embodiments, the second rigid banner support assembly comprises at least one second biasing member connecting the internal arm to the external arm and configured to permit vertical movement of the second internal arm with respect to the second external arm in response to a force.

In embodiments, the first rigid banner support assembly is positioned on the support member at a position above the second rigid banner support assembly.

In embodiments, the rigid banner support system further comprises the rigid banner.

In embodiments, in response to a wind force applied to the rigid banner above a threshold level, the first internal arm moves vertically with respect to the first external arm thereby permitting the rigid banner to at least partially bow.

In embodiments, the first biasing member reverses vertical movement of the first internal arm with respect the first external arm when the wind force drops below the threshold level.

In embodiments, the threshold level is at least partially dependent on a biasing force of the at least one first biasing member.

According to another aspect there is provided a rigid banner support system, comprising a vertical support member; a rigid banner; a first rigid banner support assembly comprising a first external arm having an open cavity and connected to the vertical support member such that the first external arm is generally normal to the vertical support member; a first internal arm located within the open cavity and connected to a first end of the rigid banner; and at least one first biasing member connecting the first external arm to the first internal arm and permitting vertical movement of the first internal arm with respect to the first external arm when a wind force above a threshold level is applied to the rigid banner; and a second rigid banner support assembly comprising a second external arm having an open cavity and connected to the vertical support member such that the second external arm is generally normal to the vertical support member at a position on the below the first external arm; and a second internal arm located within the open cavity of the second external arm and connected to a second end of the rigid banner, the second internal arm fixed in position with respect to the second external arm.

In embodiments, the rigid banner is removable from the first and second internal arms.

BRIEF DESCRIPTION OF THE DRAWINGS

Embodiments will now be described more fully with reference to the accompanying drawings in which.

DETAILED DESCRIPTION OF THE EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including but not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

In the following, a rigid banner support system is described. The rigid banner support system comprises first and second rigid banner support assemblies. The first rigid banner support assembly comprises a first external arm having an open cavity and connectable to a support member, a first internal arm located within the open cavity and connectable to a first end of a rigid banner, and at least one first biasing member connecting the internal arm to the external arm and configured to permit vertical movement of the first internal arm with respect to the first external arm in response to a force. The second rigid banner support assembly is connectable to a second end of the rigid banner and to the support member.

Figure 1:
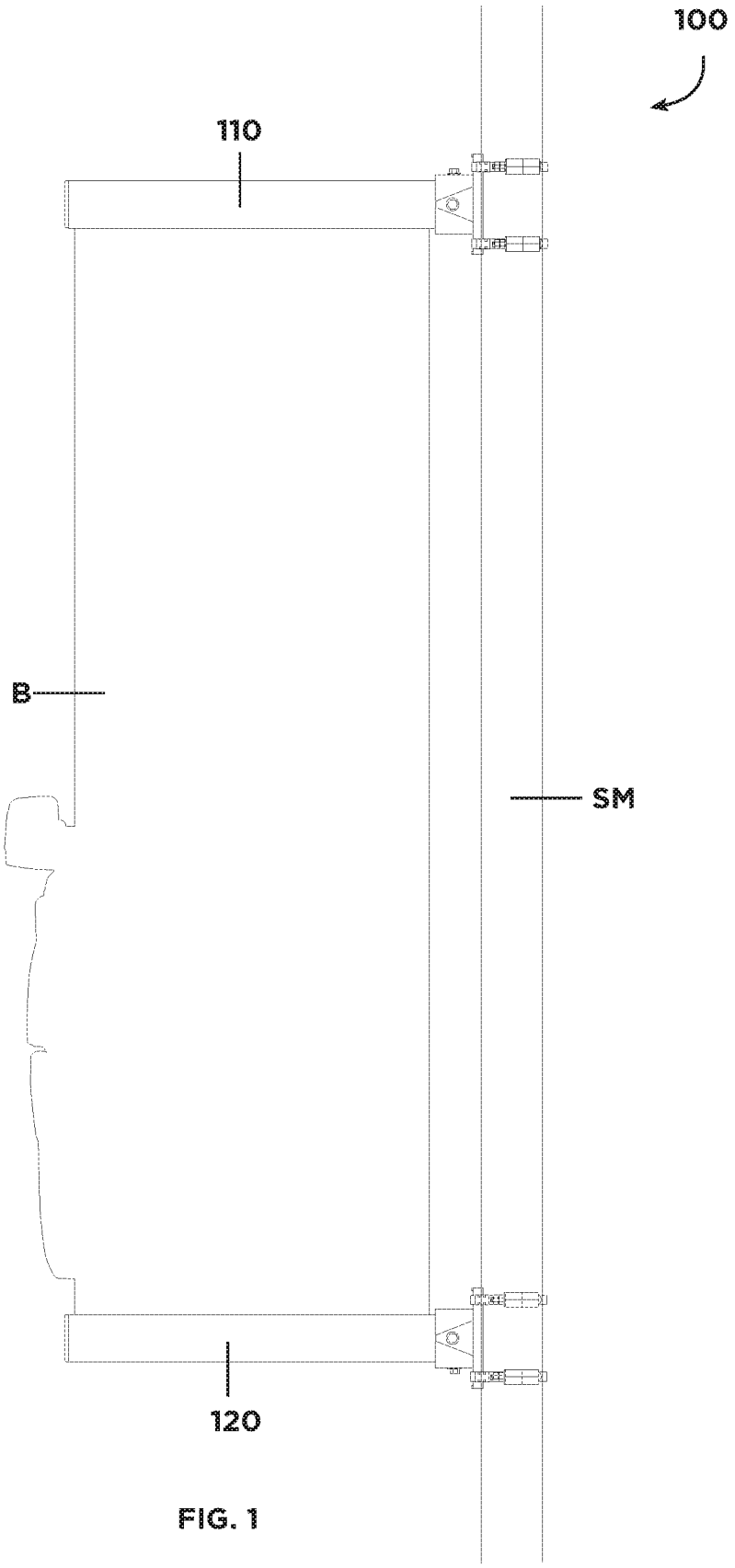
FIG. 1 is a perspective view of a rigid banner support system.
Figure 2:
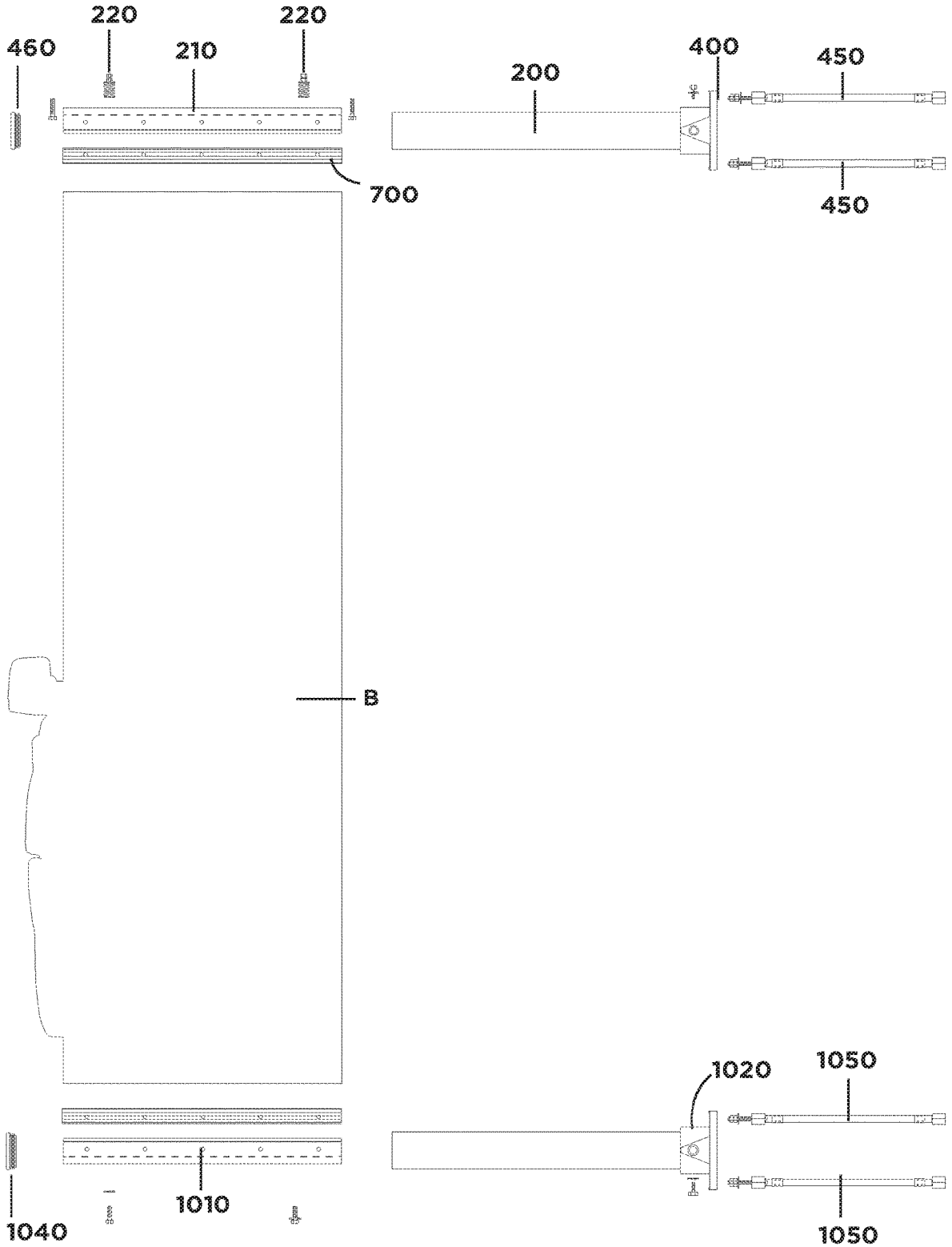
FIG. 2 is a partially exploded view of the rigid banner support system of FIG. 1.

Turning now to FIGS. 1 and 2, a rigid banner support system is shown and is generally identified by reference numeral 100. As can be seen, the rigid banner support system 100 comprises a first rigid banner support assembly 110 and a second rigid banner support assembly 120 each of which is connected to a support member SM. A first end of a rigid banner B is connected to the first banner support assembly 110 and a second end of the rigid banner B is connected to the second banner support assembly 120. As will be described, the rigid banner support assembly 100 permits bowing of the rigid banner B in response to a wind force being applied thereto. By permitting bowing of the rigid banner B, the risk of damage to the rigid banner B and/or the support member SM is reduced.

As best shown in FIG. 2, the first rigid banner support assembly 110 comprises a first external arm 200 connectable to the support member SM, a first internal arm 210 connectable to the rigid banner B, and at least one biasing member 220, which in this embodiment is two biasing members 220, connecting the first internal arm 210 to the first external arm 200 and configured to permit vertical movement of the first internal arm 210 with respect to the first external arm 200. In this embodiment, a pole bracket 400 receives one end of the first external arm 200 and is connected to the support member SM using support straps 450. An end cap 460 connects to the other end of the first external arm 200.

Figure 3:
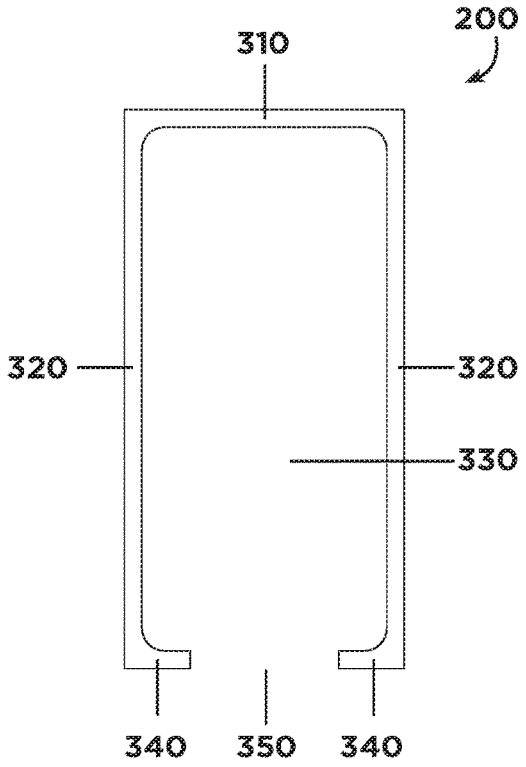
FIG. 3 is a cross-sectional view of a first external arm of a first rigid banner support assembly forming part of the rigid banner support system of FIG. 1.

In this embodiment, the first external arm 200 is made of aluminum. As shown in FIG. 3, the first external arm 200 comprises a generally flat surface 310 and two parallel-spaced walls 320 extending at first ends from opposite edges of the generally flat surface 310. An open cavity 330 is defined between the two walls 320 and the generally flat surface 310. Projections 340 extend inwards from second ends of the two walls 320 and define a gap 350. At least one opening (not shown) is defined in the generally flat surface 310. The number of openings defined in the generally flat surface 310 is equal to the number of biasing members and as such in this embodiment two (2) openings are defined.

Figure 4:
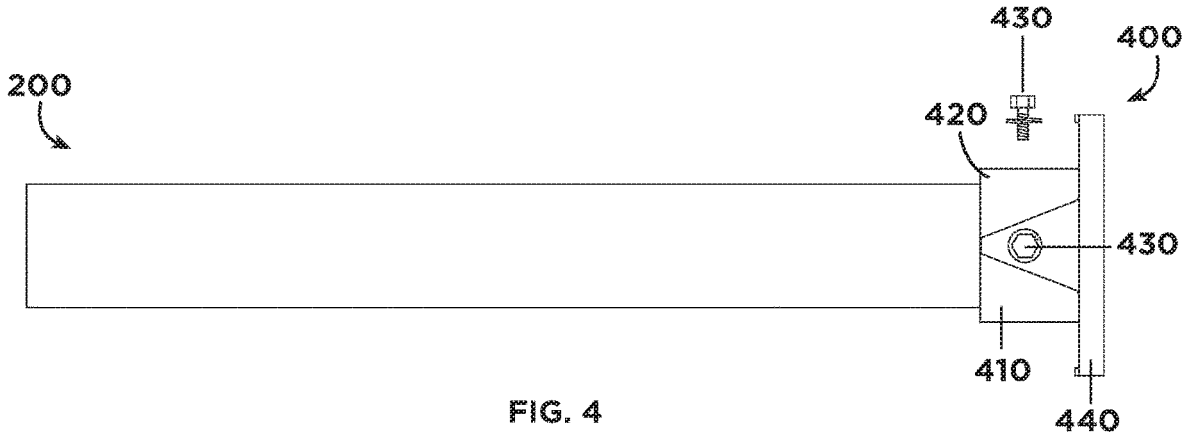
FIG. 4 is a plan view of the first external arm of FIG. 3.

As mentioned previously, the first external arm 200 is connectable to the support member SM using a pole bracket 400. In this embodiment, the pole bracket 400 is made of aluminum. As shown in FIG. 4, the pole bracket 400 comprises a hollow body 410 defining a slot 420 dimensioned to receive one end of the first external arm 200. Threaded connectors 430 such as for example nuts and bolts are used to connect the pole bracket 400 to the one end of the first external arm 200.

The pole bracket 400 comprises an attachment portion 440 that is configured to connect to the support member SM such that the first external arm 200 is generally normal thereto. When connected, the attachment portion 440 extends generally normal to a longitudinal axis of the first external arm 200. The attachment portion 440 has an indent (not shown) that is dimensioned to receive and be in contact with a portion of the support member SM.

As mentioned previously, support straps 450 such as for example ratchet straps are used to connect the pole bracket 400 to the support member SM. The support straps 450 extend around the attachment portion 440 and the support member SM.

In this embodiment, the end cap 460 is made of plastic and is dimensioned to be received and retained by the other end of the first external arm 200 via friction.

Figure 5:
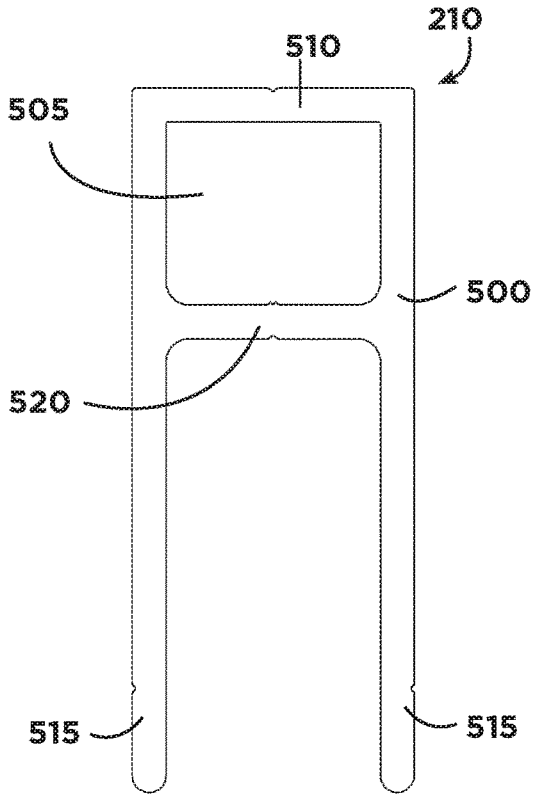
FIG. 5 is a cross-sectional view of a first internal arm of the first rigid banner support assembly forming part of the rigid banner support system of FIG. 1.
Figure 6:
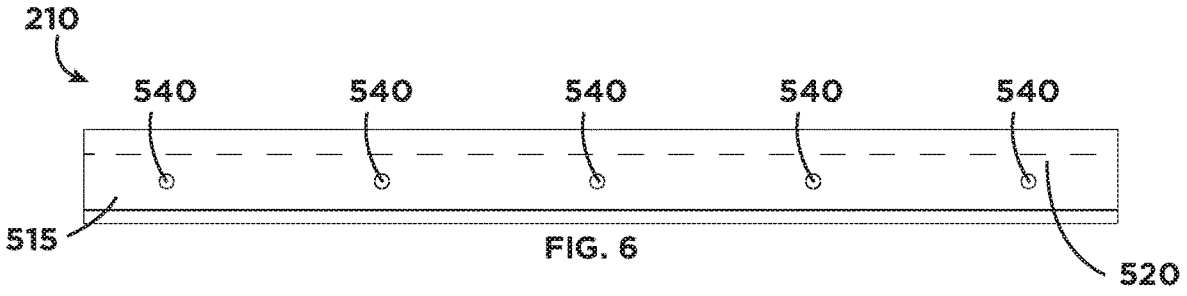
FIG. 6 is a plan view of the first internal arm of FIG. 5.

In this embodiment, the first internal arm 210 is made of aluminum. As shown in FIGS. 5 and 6, the first internal arm 210 comprises a hollow and generally rectangular elongated body 500. The body 500 defines a channel 505 and has a length that is less than a length of first external arm 200. At least one opening (not shown) is defined in a top surface 510 of the body 500. The number of openings defined in the top surface 510 of the body 500 is equal to the number of openings defined in the generally flat surface 310 of the first external arm 200. As such, in this embodiment, two (2) openings are defined in the top surface 510 of the body 500.

A pair of arms 515 extend from opposing edges along a length of the elongated body 500. The pair of arms 515, together with a bottom surface 520 of the elongated body 500, define a U-shaped channel 530 that is configured to connect to a first end of the rigid banner. As shown in FIG. 6, a plurality of openings 540, in this embodiment five (5) openings, are defined in the arms 515.

Figure 7:
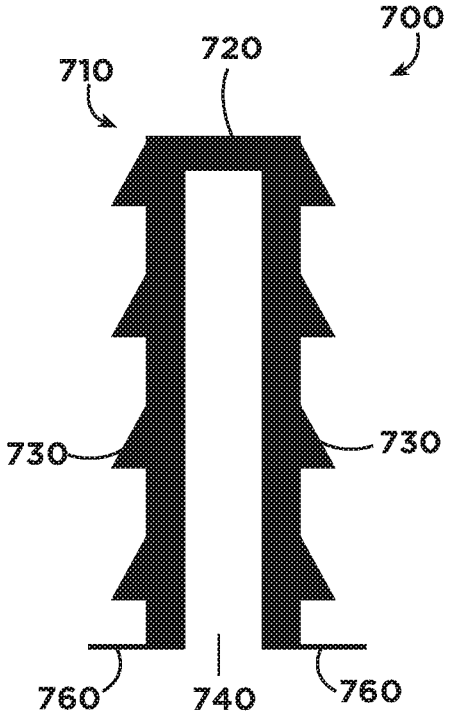
FIG. 7 is a cross-sectional view of an attachment member used to connect a rigid banner to the first internal arm of FIG. 5.
Figure 8:
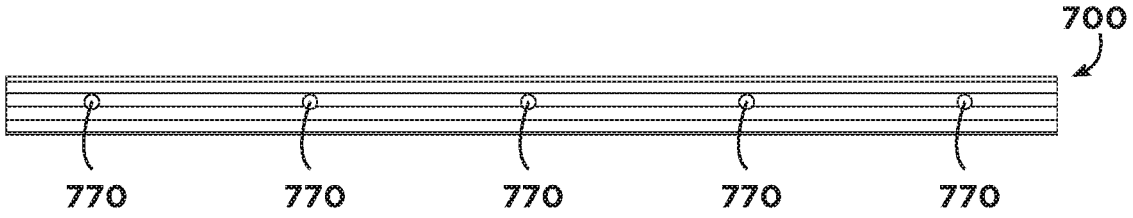
FIG. 8 is a plan view of the attachment member of FIG. 7.

In this embodiment, an attachment member 700 is used to connect a first end of the rigid banner B to the first internal arm 210. As best shown in FIGS. 7 and 8, the attachment member 700 is made of rubber and comprises a body 710 dimensioned to fit in the U-shaped channel 530 of the first internal arm 210. In this embodiment, the body 710 comprises a generally flat surface 720 and two parallel-spaced walls 730 extending at first ends from opposite edges of the generally flat surface 720. A slot 740 is defined between the two walls 730 and the generally flat surface 720. The slot 740 is dimensioned to receive and retain the first end of the banner B. A number of teeth 750, which in this embodiment is eight (8) teeth, extend from the body 710. As will be described, when the attachment member 700 is positioned within the U-shaped channel 530, the teeth 750 contact walls of the U-shaped channel 530. Projections 760 extend outward from second ends of the two walls 720.

A plurality of openings 770 are defined in the two parallel-spaced walls 730. The number of openings 770 is equal to the number of openings 540 defined in the arms 515 of the first internal arm 210. As such, in this embodiment, five (5) openings are defined in the two parallel-spaced walls 730.

Figure 9A:
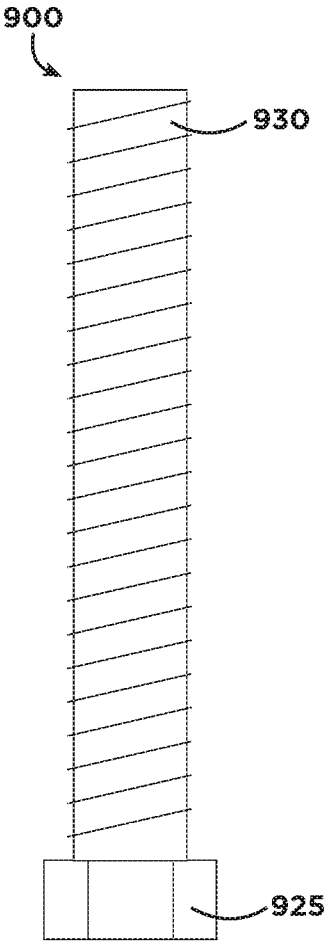
FIGS. 9*a* to 9*c* are plan views of various components of a biasing member of the first rigid banner support assembly forming part of the rigid banner support system of FIG. 1.
Figure 9B:
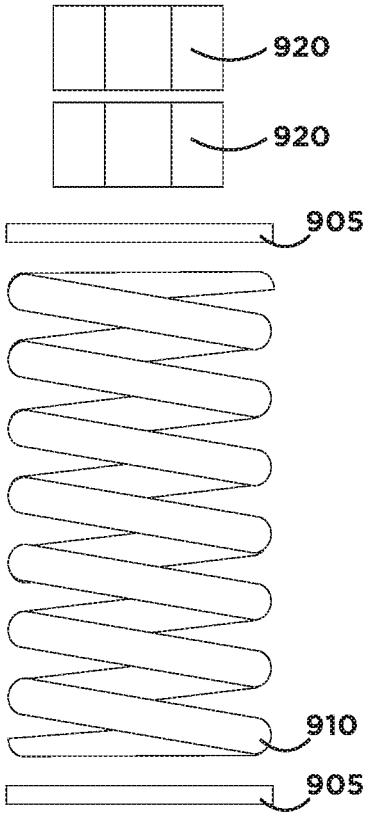
Figure 9C:
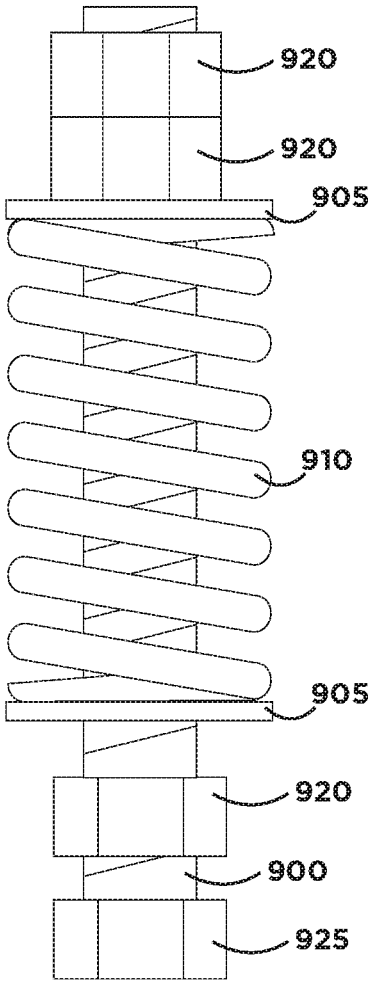

One of the biasing members 220 is best shown in FIGS. 9*a* to 9*c*. As can be seen, in this embodiment, the biasing member 220 comprises a bolt 900, washers 905, a spring 910 and nuts 920. The bolt 900 comprises a head 925 and a threaded body 930 extending therefrom. The washers 905 and the spring 910 are dimensioned to circumscribe the threaded body 930 of the bolt 900. The nuts 920 are dimensioned to threadably engage the threaded body 930 of the bolt 900. As will be described, the biasing members 220 connect the first internal arm 210 to the first external arm 200 and permit vertical movement of the internal arm 210 with respect to the first external arm 200 in response to a force. Put another way, the spring 910 provides a biasing force to the first internal arm 210.

Figure 10:
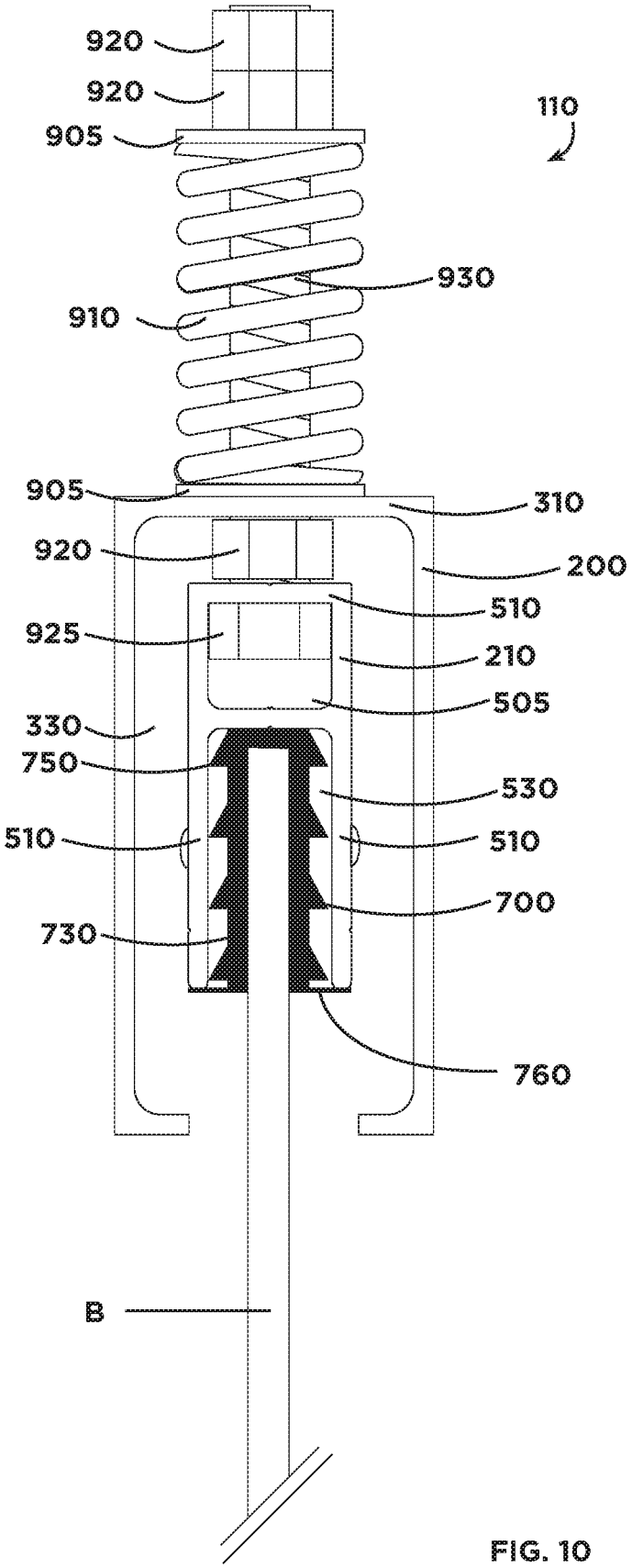
FIG. 10 is a cross-sectional view of the first rigid banner support assembly forming part of the rigid banner support system of FIG. 1.

A cross-sectional view of the assembled first rigid banner assembly 110 together with a rigid banner B is shown in FIG. 10. To assemble the first rigid banner assembly 110, the first end of the rigid banner B is inserted into the slot 740 of the attachment member 700. If required, five (5) holes are drilled into the rigid banner B and these openings are aligned with the five (5) openings 770 defined in the two parallel-spaced walls 730 of the attachment member 700. The attachment member 700 together with the rigid banner B, are positioned within the U-shaped channel 530 of the first internal arm 210 such that the teeth 750 contact walls of the U-shaped channel 530 and the projections 760 contact surfaces of the arms 510. As will be appreciated, the teeth 750 of the attachment member 700 act to stabilize the attachment member 700 within the U-shaped channel 530 to keep the rigid banner B in position. The five (5) openings 770 defined in the two parallel-spaced walls 730 (and the five openings in the banner) are aligned with the five (5) openings 540 defined in the arms 515 of the first internal arm 210. Threaded connectors such as for example bolts are inserted through the aligned openings and secured using the nuts. As such, the first internal arm 210 is connected to the first end of the rigid banner B.

The first internal arm 210 together with the attachment member 700 and the first end of the rigid banner B are positioned within the cavity 330 of the first external arm 200 such that the rigid banner B extends out from the gap 350. The two openings defined in the top surface 510 of the body 500 of the first internal arm 210 are aligned with the two openings defined in the generally flat surface 310 of the first external arm 200.

For each biasing member 220, one of the nuts 920 is positioned between the aligned openings of the first internal arm 210 and the first external arm 200. Each bolt 900 is positioned such that the head 925 is positioned within the channel 505 of the first internal arm 210 and the threaded body 930 extends through the opening defined in the top surface 510 of the body 500 of the first internal arm 210. The bolt 900 is rotated such that it mates with the one of the nuts 920 and extends through the opening defined in the generally flat surface 310 of the first external arm 200. The bolt 900 is rotated until the one of the nuts 920 is in contact with an outer surface of the body 500 of the first internal arm 210 and an inner surface of the generally flat surface 310 of the first external arm 200. One of the washers 905 is placed around the bolt 900 and contacts an outer surface of the generally flat surface 310 of the first external arm 200. The spring 910 is then positioned around the bolt 900 such that a first end of the spring 910 contacts the washer 905. A second one of the washers 905 is positioned around the bolt 900 and contacts a second end of the spring 910. Two nuts 920 are rotated on the bolt 900 until a bottom one of the two nuts 920 contacts the second one of the washer 905 and at least partially compresses the spring 910.

One end of the first external arm 200 is positioned within the slot 420 of the pole bracket 400 and the threaded connectors 430 are used to connect the first external arm to the pole bracket 400. The end cap 460 is placed on the other end of the first external arm 200.

As shown in FIG. 10, once assembled, the first internal arm 210 is connected to the first external arm 200. The biasing members 220 permit vertical movement of the first internal arm 210 with respect to the first external arm 200 in response to a force above a threshold level. Put another way, when no force acts on the first internal arm 210, or the force acting on the first internal arm 210 is below a threshold level, the first internal arm 210 is held in position with respect to the first external arm 200, the position being shown in FIG. 10. When a force acts on the first internal arm 210 above the threshold level, the springs 910 of the biasing members 200 at least partially compress thereby allowing the first internal arm 210 to move vertically with respect to the first external arm 200. The amount of vertical movement permitted by the biasing members 200 is at least partially defined by a biasing force or spring force of the springs 910 of the biasing members 200 and a length of the bolt 900. The threshold level may be based on wind speed such as for example 30 km/h, 50 km/h, etc.

Turning back to FIGS. 1 and 2, the second rigid banner support assembly 120 comprises a second external arm 1000 connectable to the support member SM and a second internal arm 1010 connectable to the rigid banner B. In this embodiment, a pole bracket 1020 receives one end of the second external arm 1000 and is connected to the support member SM using support straps 1050. An end cap 1040 connects to the other end of the second external arm 1000.

Figure 11:
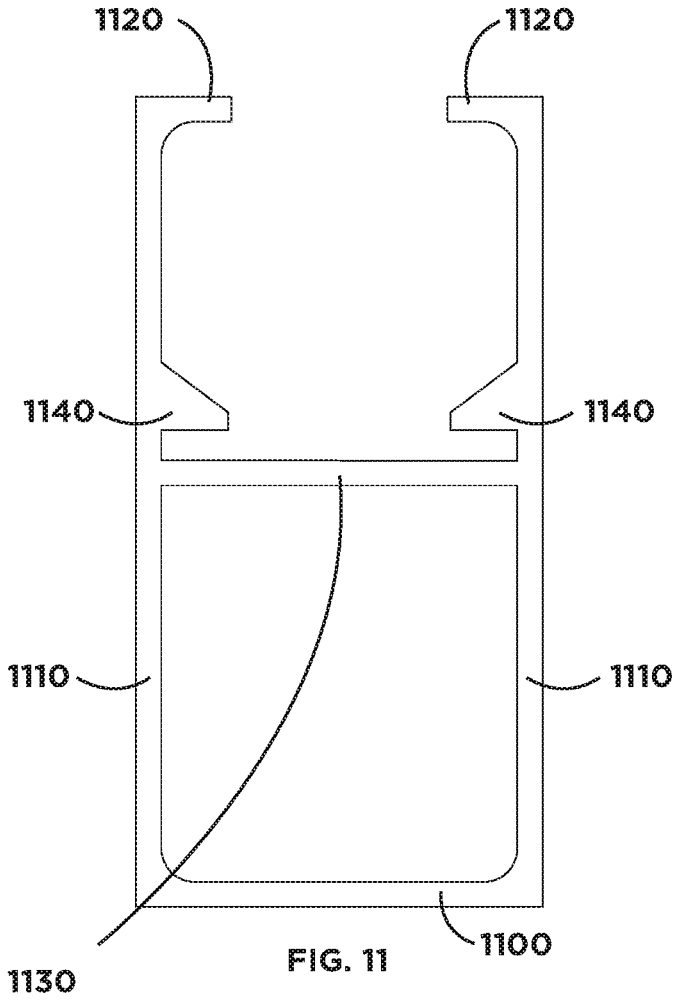
FIG. 11 is a cross-sectional view of a second external arm of a second rigid banner support assembly forming part of the rigid banner support system of FIG. 1.
Figure 12:
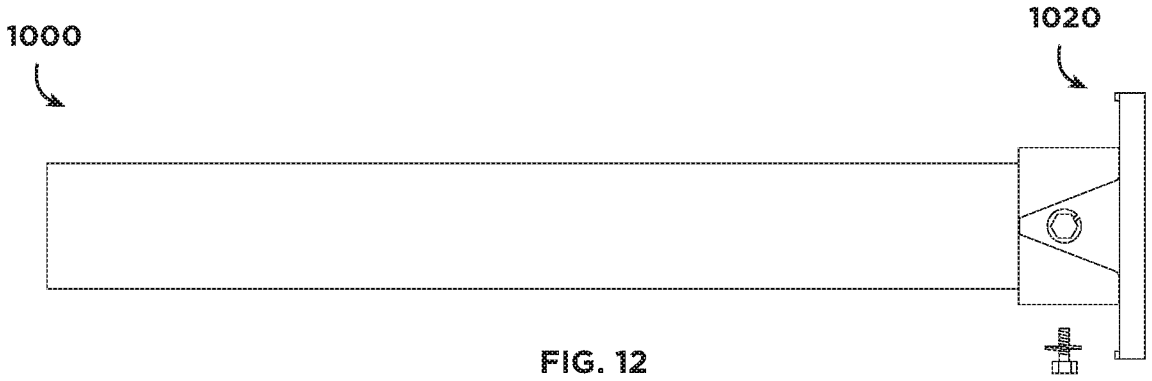
FIG. 12 is a plan view of the second external arm of FIG. 11.

In this embodiment, the second external arm 1000 is made of aluminum. As shown in FIGS. 11 and 12, the second external arm 1000 comprises a generally flat surface 1100 and two parallel-spaced walls 1110 extending at first ends from opposite edges of the generally flat surface 1100. Projections 1120 extend inwards from second ends of the two walls 1110. A generally flat divider 1130 is connected to each wall 1110 and extends the length of the second external arm 1000 at a space above the generally flat surface 1100. A protrusion 1140 extends generally inward from each wall 1110 at a location above the divider 1130. As will be described, the protrusions 1140 together with the divider 1130 define a slot configured to receive and retain the second internal arm 1010.

Figure 13:
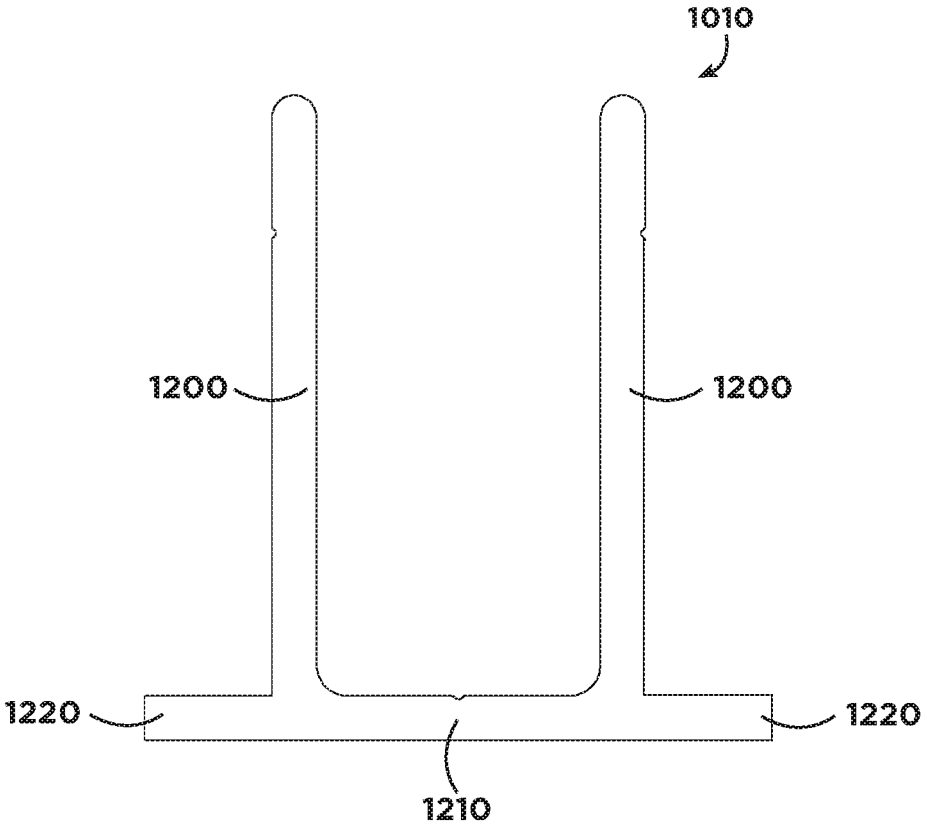
FIG. 13 is a cross-sectional view of a second internal arm of the second rigid banner support assembly forming part of the rigid banner support system of FIG. 1.

The second internal arm 1010 is generally identical to the first internal arm 210 with the following exception. As shown in FIG. 13, parallel-spaced walls 1200 of the second internal arm 1010 are inset with respect to edges of the generally flat surface 1210 defining lips 1220. As can be seen, the shape of the second internal arm 1010 is complementary to the slot defined by the protrusions 1140 and divider 1130 of the second external arm 1000.

The second internal arm 1010 connects to a second end of the banner B using an attachment member generally identical to the attachment member 700 described above.

The pole bracket 1020 is generally identical to pole bracket 400. The end cap 1040 is generally identical to the end cap 460. The support straps 1050 are generally identical to the support straps 450.

To assemble the second rigid banner assembly 120, the second end of the rigid banner B is connected to the second internal arm 1010 using the attachment member. Again, this is done in a similar manner to connecting the rigid banner B to the first internal arm 210. The second internal arm 1010 is inserted into the second external arm 1000. The second internal arm 1010 is held in position as the lips 1220 are retained by the slots defined by the protrusions 1140 and divider 1130. Threaded connectors (not shown) may additionally be used to secure the second internal arm 1010 to the second external arm 1000.

One end of the second external arm 1000 is positioned within the slot of the pole bracket 1020 and threaded connectors are used to connect the second external arm 1000 to the pole bracket. The end cap 1040 is placed on the other end of the second external arm 1000.

Once assembled, the second internal arm 1010 is fixed in position with respect to the second external arm 1000. As will be described in more detail below, the second rigid banner support assembly 120 holds the second end of the banner B in place such that it is fixed in position even when under stress of a wind force.

Figure 14A:
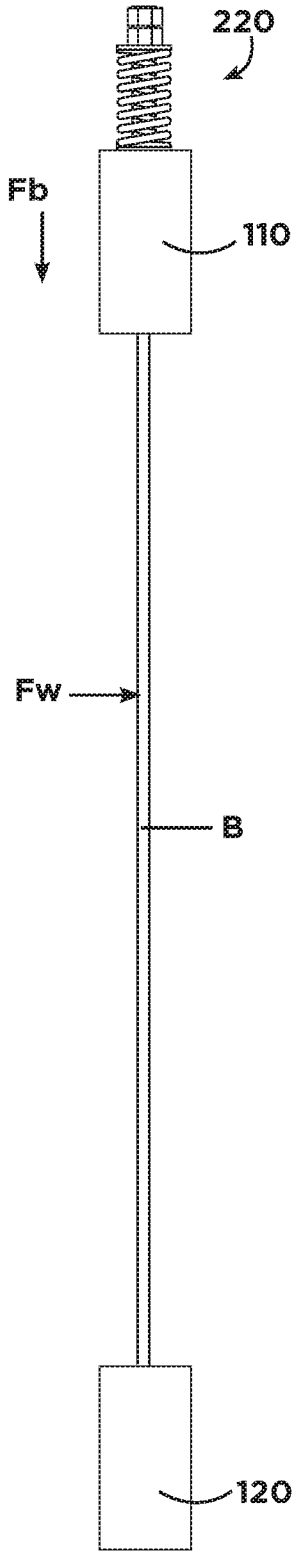
FIG. 14*a* is a side view of the rigid banner support system of FIG. 1 under no stress.
Figure 14B:
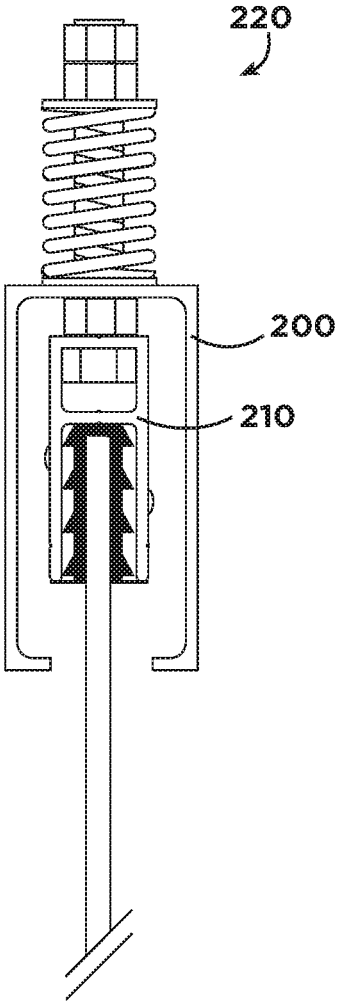
FIG. 14*b* is a cross-sectional view of the first rigid banner support assembly of the rigid banner support system of FIG. 1 under no stress.

During use of the rigid banner support system 100, the first and second rigid banner assemblies 110, 120 are connected to respective ends of the rigid banner B. The first rigid banner assembly 110 is connected to the support member SM using support straps 450 such that the first rigid banner assembly 110 is generally normal to the support member SM. The second rigid banner assembly 120 is connected to the support member SM at a position below the first rigid banner assembly 110 using support straps 1050 such that the second rigid banner assembly 120 is generally normal to the support member SM. As such, the rigid banner B is held in position with respect to the support member SM creating an aesthetically pleasing display. An example is shown in FIGS. 14*a* and 14*b*. The biasing members 220 provide a biasing force $F_b$ generally normal to a wind force $F_w$ that may act on the rigid banner B.

When not under stress, that is, when the wind force $F_w$ is below a threshold level, the biasing members 220 provide a biasing force $F_b$ that holds the first internal arm 210 in position with respect to the first external arm 200 (see FIG. 14*a*) thereby keeping the rigid banner B straight or taut (as shown in FIG. 14*b*).

Figure 15A:
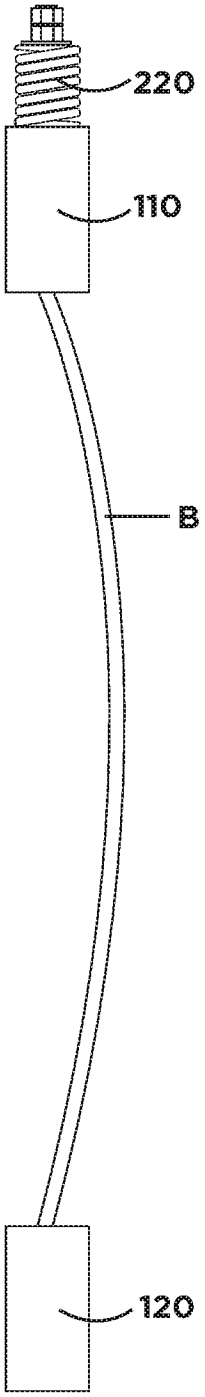
FIG. 15*a* is a side view of the rigid banner support system of FIG. 1 under stress.
Figure 15B:
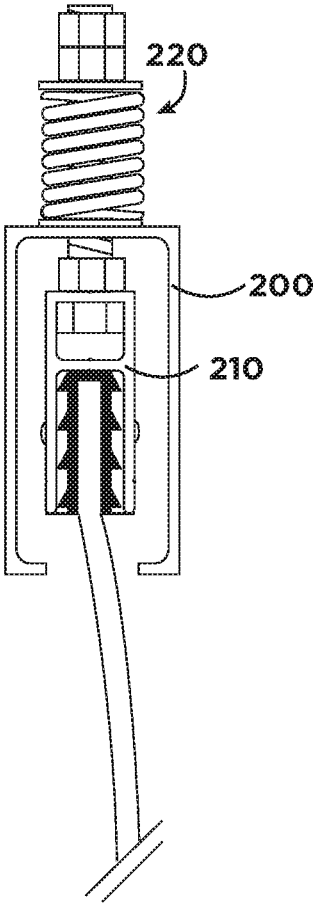
FIG. 15*b* is a cross-sectional view of the first rigid banner support assembly of the rigid banner support system of FIG. 1 under stress.

When the wind force $F_w$ reaches or goes above the threshold level, the wind force causes stress on the rigid banner B. When under stress, the biasing members 220 permit the first internal arm 210 to move vertically with respect to the first external arm 200. Specifically, the wind force $F_w$ acts on the rigid banner B which transfers through the first internal arm 210 and to the biasing members 220. This causes the first internal arm 210 to move vertically with respect to the first external arm 200 and compresses the springs 910 of the biasing members 220. Since the first end of the rigid banner B is connected to the first internal arm 210, the first end of the rigid banner B also moves vertically with respect to the first external arm 200 permitting the rigid banner B to bow. An example is shown in see FIGS. 15*a* and 15*b*.

Once the wind force $F_w$ goes below the threshold level, the biasing members 220 bring the first internal arm 210 back into position with the first external arm 200 thereby causing the rigid banner B to un-bow and return to the straight or taut position (shown in FIGS. 14*a* and 14*b*). Put another way, the biasing members 220 reverse the vertical movement of the first internal arm 210 with respect to the first external arm 220 when the wind force $F_w$ drops below the threshold level. The threshold level may be based on wind speed such as for example 30 km/h, 50 km/h, etc.

As will be appreciated, the threshold level may be dependent on one or more of a spring force of each biasing member, wind speed and the weight of the rigid banner.

As will be appreciated the biasing force and/or threshold level may be changed by replacing the spring of each biasing member with a different sized spring or with a spring having a different spring force.

Although in embodiments the second rigid banner support assembly is described as being different than the first rigid banner support assembly in that it holds the second end of the rigid banner B in a fixed position, those skilled in the art will appreciate that in another embodiment the second rigid banner support assembly may identical to the first rigid banner support assembly. In this embodiment, the second rigid banner support assembly comprises biasing members that permit vertical movement of the second internal arm with respect to the second external arm.

Those skilled in the art will appreciate that the rigid banner may be readily removed and/or replaced from the rigid banner support system.

Although in embodiments the support member is described as being a vertical support member, those skilled in the art will appreciate that the support member may be a horizontal support member.

Although in embodiments brackets are used to connect the first and second rigid banner support assemblies to the support member, those skilled in the art will appreciate that alternatives are available. For example, in another embodiment, one end of the first and second external arms may be shaped to receive a portion of the support member.

Although in embodiments straps are used to connect the first and second rigid banner support assemblies to the support member, those skilled in the art will appreciate that alternatives are available. For example, in another embodiment, the first and second rigid banner support assemblies may be connected to the support member using threaded connectors such as screws.

Although in embodiments the rigid banner is described as being connected to the first and second rigid banner support assemblies before the rigid banner support system is connected to the support member, those skilled in the art will appreciate that in other embodiments the rigid banner may be connected to the first and second rigid banner support assemblies after they are connected to the support member.

Although in embodiments the first rigid banner support assembly is described as having two biasing members, those skilled in the art will appreciate that any number of biasing members may be used.

Although in embodiments components of the first and second rigid banner assemblies are described as being made of aluminum, those skilled in the art will appreciate that other materials may be used such as for example stainless steel, plastic, etc.

Although in embodiments the attachment member is described as comprising a number of teeth that contact interior walls of the U-shaped channel, those skilled in the art will appreciate that alternatives may be used. For example, in another embodiment the attachment member may be sized and shaped such that, together with the first end of the rigid banner, it fills the entire U-shaped channel of the first interior arm.

Although embodiments have been described above with reference to the accompanying drawings, those of skill in the art will appreciate that variations and modifications may be made without departing from the scope thereof as defined by the appended claims.

What is claimed is:

1. A rigid banner support assembly, comprising:

an external arm having an open cavity and connectable to a support member;

an internal arm located within the open cavity and connectable to a rigid banner; and at least one biasing member connecting the internal arm to the external arm and configured to permit vertical movement of the internal arm with respect to the external arm in response to a force.

2. The rigid banner support assembly of claim 1, wherein the at least one biasing member comprises:

a bolt extending through aligned openings in the external arm and the internal arm;

a spring circumscribing the bolt at a position outside of the open cavity of the external arm; and at least one nut threadably connected to the bolt and in contact with the spring, the spring positioned between an outer surface of the external arm and the at least one nut.

3. The rigid banner support assembly of claim 1, wherein, when connected to the rigid banner, the internal arm moves vertically with respect to the external arm in response to a wind force above a threshold level being applied to the rigid banner.

4. The rigid banner support assembly of claim 3, wherein the threshold level is at least partially dependent on a biasing force of the at least one biasing member.

5. The rigid banner support assembly of claim 4, wherein the biasing force is a spring force.

6. The rigid banner support assembly of claim 4, wherein the biasing force is generally normal to the wind force.

7. The rigid banner support assembly of claim 3, wherein the rigid banner bows in response to the wind force thereby causing the internal arm to move vertically with respect to the external arm.

8. The rigid banner support assembly of claim 1, wherein the external arm comprises:

a generally flat surface; and two parallel-spaced walls extending at first ends from opposite edges of the generally flat surface, the open cavity defined between the two walls and the generally flat surface; and projections extending inwards from second ends of the two parallel-spaced walls, the projections defining a gap.

9. The rigid banner support assembly of claim 1, wherein a range of vertical movement of the internal arm with respect to the external arm is at least partially defined by a biasing force of the biasing member.

10. The rigid banner support assembly of claim 1, wherein the internal arm comprises:

a hollow and generally rectangular elongated body; and a pair of arms extending from opposing edges along a length of the elongated body which, together with a surface of the elongated body, define a U-shaped channel configured to receive a first end of the rigid banner.

11. The rigid banner support assembly of claim 10, further comprising an attachment member comprising a body defining a slot, the slot configured to receive the first end of the rigid banner and the body dimensioned to fit within the U-shaped channel of the internal arm.

12. The rigid banner support assembly of claim 11, wherein the attachment member comprises a number of teeth extending from the body, the teeth contacting walls of the U-shaped channel.

13. The rigid banner support assembly of claim 1, further comprising a pole bracket defining a slot dimensioned to receive and connect to one end of the external arm and comprising an attachment portion configured to connect to the support member such that the external arm is generally normal thereto.

14. The rigid banner support assembly of claim 13, further comprising at least one strap configured to connect the attachment portion to the support member.

15. The rigid banner support assembly of claim 1, wherein the external arm and the internal arm are made of an aluminum material.

16. A rigid banner support system, comprising:

a first rigid banner support assembly comprising:

a first external arm having an open cavity and connectable to a support member;

a first internal arm located within the open cavity and connectable to a first end of a rigid banner; and at least one first biasing member connecting the internal arm to the external arm and configured to permit vertical movement of the first internal arm with respect to the first external arm in response to a force; and a second rigid banner support assembly connectable to a second end of the rigid banner.

17. The rigid banner support system of claim 16, wherein the second rigid banner support assembly comprises:

a second external arm having an open cavity and connectable to the support member; and a second internal arm located within the open cavity and connectable to the second end of the rigid banner.

18. The rigid banner support system of claim 17, wherein the second internal arm is fixed in position with respect to the second external arm.

19. The rigid banner support system of claim 17, wherein the second rigid banner support assembly comprises at least one second biasing member connecting the internal arm to the external arm and configured to permit vertical movement of the second internal arm with respect to the second external arm in response to a force.

20. The rigid banner support system of claim 16, wherein the first rigid banner support assembly is positioned on the support member at a position above the second rigid banner support assembly.

21. The rigid banner support system of claim 16, further comprising the rigid banner.

22. The rigid banner support system of claim 21, wherein, in response to a wind force applied to the rigid banner above a threshold level, the first internal arm moves vertically with respect to the first external arm thereby permitting the rigid banner to at least partially bow.

23. The rigid banner support system of claim 22, wherein the first biasing member reverses vertical movement of the first internal arm with respect the first external arm when the wind force drops below the threshold level.

24. The rigid banner support system of claim 23, wherein the threshold level is at least partially dependent on a biasing force of the at least one first biasing member.

25. A rigid banner support system, comprising:

a vertical support member;

a rigid banner;

a first rigid banner support assembly comprising:

a first external arm having an open cavity and connected to the vertical support member such that the first external arm is generally normal to the vertical support member;

a first internal arm located within the open cavity and connected to a first end of the rigid banner; and at least one first biasing member connecting the first external arm to the first internal arm and permitting vertical movement of the first internal arm with respect to the first external arm when a wind force above a threshold level is applied to the rigid banner; and a second rigid banner support assembly comprising:

a second external arm having an open cavity and connected to the vertical support member such that the second external arm is generally normal to the vertical support member at a position on the below the first external arm; and a second internal arm located within the open cavity of the second external arm and connected to a second end of the rigid banner, the second internal arm fixed in position with respect to the second external arm.

26. The rigid banner support system of claim 25, wherein the rigid banner is removable from the first and second internal arms.

* * * * *